US005911423A

United States Patent [19]

Pellegrini, Jr. et al.

[11] Patent Number: 5,911,423

[45] Date of Patent: Jun. 15, 1999

[54] BRAKING DEVICE, PARTICULARLY FOR SKATES

[75] Inventors: Alfred Pellegrini, Jr., Montebelluna; Andrea Tormena, Crocetta Del Montello; Ernesto Benvenuto, S. Gaetano Di Montebelluna, all of Italy

[73] Assignee: Nordica, S.p.A., Trevignano, Italy

[21] Appl. No.: 09/161,941

[22] Filed: Sep. 28, 1998

Related U.S. Application Data

[63] Continuation of application No. 08/388,103, Feb. 13, 1995, which is a continuation of application No. 08/051,541, Apr. 23, 1993, Pat. No. 5,388,844.

[30] Foreign Application Priority Data

Apr. 29, 1992 [IT] Italy ..... TV9200025
Sep. 25, 1992 [IT] Italy ..... TV9200046

[51] Int. Cl.[6] ..... A63C 17/14

[52] U.S. Cl. ..... 280/11.2; 188/29

[58] Field of Search ..... 280/11.2, 11.22, 280/11.19; 188/29, 72.7, 72.9, 196 R

[56] References Cited

U.S. PATENT DOCUMENTS

| | | | |
|---|---|---|---|
| 862,849 | 8/1907 | Rumble | 280/11.2 |
| 920,848 | 5/1909 | Eubank, Jr. | 280/11.2 |
| 922,774 | 5/1909 | Kennedy | 280/11.27 X |
| 926,646 | 6/1909 | Eubank, Jr. | 280/11.2 |
| 979,169 | 12/1910 | Kennedy | 280/11.2 |
| 1,402,010 | 1/1922 | Ormiston | 280/11.2 |
| 1,497,224 | 6/1924 | Ormiston | 280/11.2 |
| 1,552,541 | 9/1925 | Clark | 280/11.2 |
| 1,687,739 | 10/1928 | Slusher | 280/11.2 |
| 2,179,592 | 11/1939 | Goettie | 280/11.2 |
| 3,288,251 | 11/1966 | Sakwa | 280/11.2 |
| 3,749,413 | 7/1973 | Nicolson | 280/11.2 |
| 3,767,220 | 10/1973 | Peterson | 280/11.2 |
| 4,033,596 | 7/1977 | Andersen et al. | 280/11.2 |
| 4,275,895 | 6/1981 | Edwards | 280/11.2 |

*Primary Examiner*—J J Swann
*Assistant Examiner*—Michael Mar
*Attorney, Agent, or Firm*—Hale and Dorr LLP

[57] ABSTRACT

A braking device for skates including an item of footgear composed of a quarter articulated to a shell in turn associated with a supporting frame for one or more wheels. A rod member is articulated to a plate having a slot for the sliding and pivoting of rods which clamp a pair of disks laterally associated with one of the wheels, when the quarter is tilted back by the user.

15 Claims, 3 Drawing Sheets

BRAKING DEVICE, PARTICULARLY FOR SKATES

CROSS REFERENCE TO RELATED APPLICATIONS

This application is a continuation of Ser. No. 388,103, filed Feb. 13, 1995, which itself is a continuation of Ser. No. 51,541 filed Apr. 23, 1993 and now U.S. Pat. No. 5,388,844 issued Feb. 14, 1995.

BACKGROUND OF THE INVENTION

The present invention relates to a braking device, particularly usable for skates which comprise an item of footgear composed of a quarter articulated to a shell which is in turn associated with a supporting frame for one or more wheels.

Currently, it is a strongly felt problem that of providing a braking device for roller skates, whether comprising an item of footgear associated with a support for two pairs of wheels arranged parallel to each other or an item of footgear associated with a supporting frame for one or more aligned wheels.

Adapted pads, usually made of rubber, are currently used. The pads are arranged at the toe or heel region of the item of footgear, and a forward or backward inclination causes the free ends of the pads to interact with the ground and thus achieve a braking action.

However, these known solutions are not satisfactory, because they require the user to rotate the item of footgear, and thus the frame associated therewith, at the toe or at the heel, and this can cause loss of balance.

As a partial solution to this drawback, U.S. Pat. No. 4,275,895 discloses a brake for skates provided with two pairs of mutually parallel wheels which acts at the rear wheels.

The brake comprises a flap associated with the item of footgear in a rearward position; a blade is associated with the flap in a rearward position and is pivoted at the supporting frame of the item of footgear.

The blade has, at its free end, a transverse element on which C-shaped elements are formed at its lateral ends. The C-shaped elements interact, following a backward rotation imparted to the flap, with the rear wheels which face them, in that they interact with the rolling surface of the wheels.

However, this solution too has drawbacks: it is in fact structurally complicated and therefore difficult to industrialize. It furthermore entails the presence of adapted springs the function whereof is to allow the flap to return to the condition in which the C-shaped elements do not interact with the wheels, this further increasing structural complexity.

Furthermore, the structural configuration of the brake causes the C-shaped elements to interact with the wheel even upon a minimal backward rotation imparted to the flap, and therefore also because of involuntary movements, this producing unwanted braking actions.

Finally, the interaction of the C-shaped element at the rolling surface of the wheels leads to their rapid wear and thus to non-optimum rolling, which necessarily entails continuous replacement of the wheels.

U.S. Pat. No. 4,805,936 discloses a wheeled ski which is provided with a first wheel, located at the tip of the ski, and with a pair of mutually parallel tail wheels.

The ends of a pair of clamps interact with said pair of tail wheels. The clamps have to be activated by the skier through adapted cables which can be tensioned at levers which are provided on the ski-sticks.

This solution, too, intrinsically has considerable drawbacks, as it cannot be transferred to skates, since, on one hand, the presence of ski-sticks is not required for skates and, on the other hand, any cables connected to levers which can be gripped by the user would certainly create instability conditions for said user, due to the need to coordinate the movements of the legs with those of the arms.

Secondly, the presence of cables would be very dangerous, since they might accidentally catch in objects protruding from the ground or might catch in other athletes.

SUMMARY OF THE INVENTION

The aim of the present invention is to eliminate the drawbacks described above in conventional brakes by providing a braking device for skates which is structurally very simple and easy to industrialize.

Within the scope of the above aim, an important object is to provide a braking device which can be activated by the user in case of actual need and never accidentally.

Another important object is to provide a braking device which can be deactivated rapidly and easily by the user.

Another important object is to provide a highly effective braking device which however, has no effect on the wear of the rolling surface of the wheels.

Another important object is to provide a device which allows the user to brake in safety conditions.

Another object is to provide a device which associates with the preceding characteristics that of being reliable and safe in use, and has low manufacturing costs.

This aim, these objects and others which will become apparent hereinafter are achieved by a braking device, particularly for skates comprising an item of footgear having a quarter articulated to a shell which is associated with a supporting frame for a plurality of wheels, characterized in that it comprises a rod member associated with said quarter and slideable with respect to said shell, said rod member having a braking end adapted to act on at least one of said wheels when said quarter is rotated.

BRIEF DESCRIPTION OF THE DRAWINGS

Further characteristics and advantages of the present invention will become apparent from the detailed description of a particular embodiment, illustrated only by way of non-limitative example in the accompanying drawings, wherein.

DESCRIPTION OF THE PREFERRED EMBODIMENTS

Figure 2:
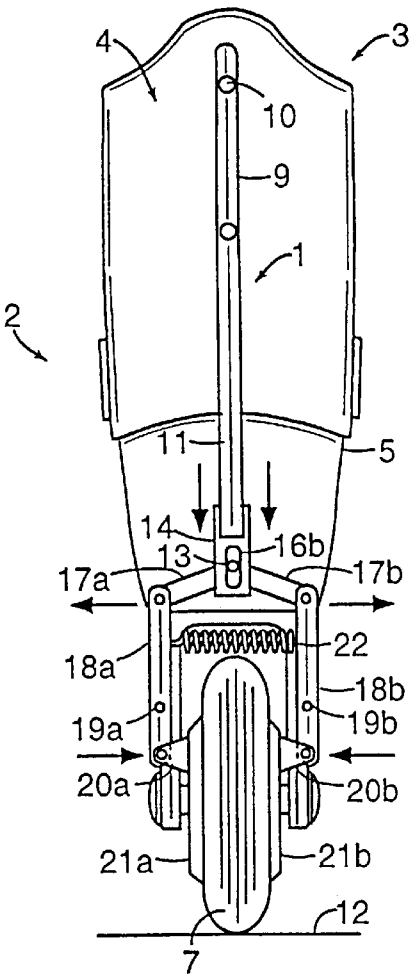
FIG. 2 is a rear view of the braking device applied to the skate.
Figure 1:
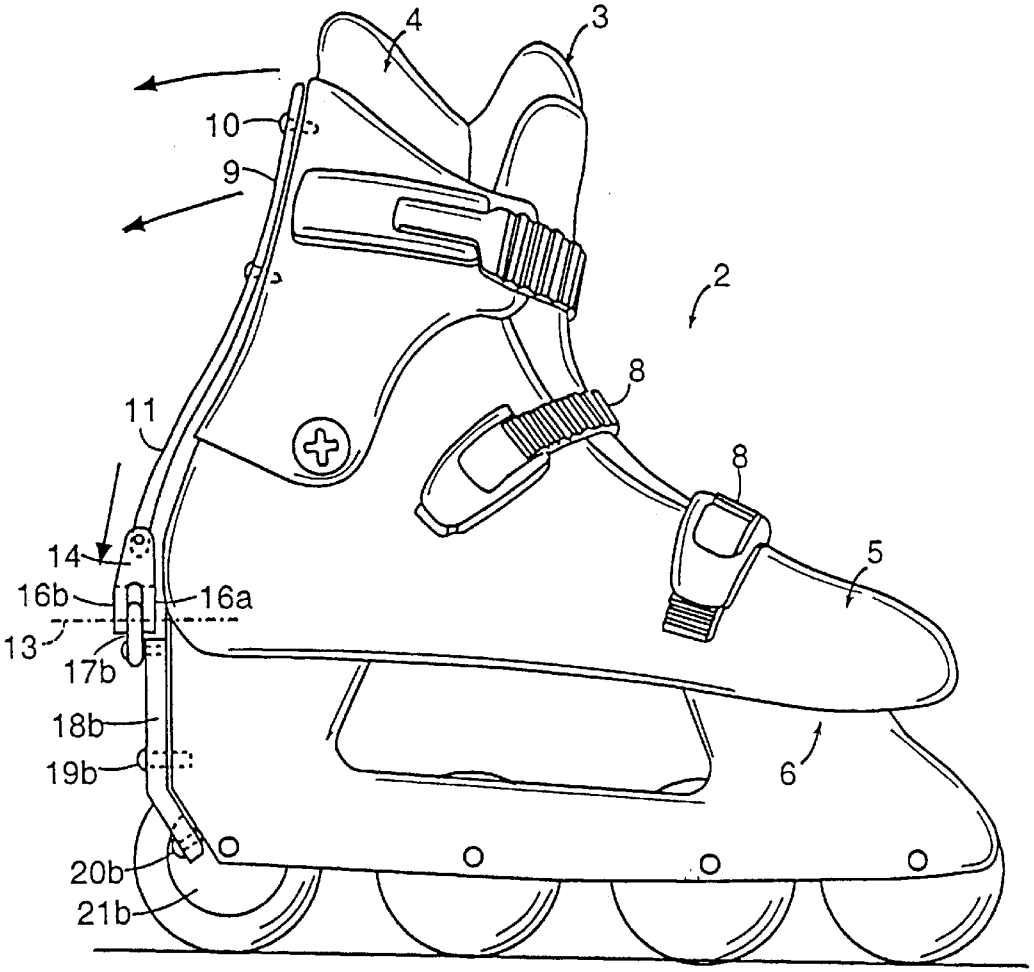
FIG. 1 is a side view of the braking device associated with the skate.

With reference to FIGS. 1–2, the reference numeral 1 designates the braking device, particularly usable for skates, designated by the reference numeral 2, which comprise an item of footgear 3 composed of a quarter 4 embracing the lateral and rear region of the user's leg and is articulated to a shell 5.

A supporting frame 6 for one or more wheels is associated below the shell. The wheels are designated by the reference numeral 7 and are possibly mutually aligned.

There are also adapted securing levers 8 for the quarter 4 and the shell 5.

The braking device comprises at least one rod member, designated by the reference numeral 9, which is arranged to the rear of the item of footgear 3 and is connected to the quarter 4 by means of one or more suitable fixing means such as for example first screws or rivets 10.

The rod member 9 is shaped complementarily with respect to the quarter 4 and partially with respect to the shell 5, and therefore has a shape with substantially two curves suitable to arrange its terminal end 11, which is directed toward the ground 12, in a region which is adjacent to, and arranged above, at least one wheel 7; the rod member 9 is furthermore freely slideable with respect to the shell 5.

The end of a plate 14 is articulated to the terminal end 11 of the rod member 9. The plate is thus oscillatable with respect to the longitudinal axis of said rod member 9.

The plate 14 is C-shaped, and longitudinal slots 16*a* and 16*b* are formed at its wings 15, which are arranged parallel to the lateral surface of the shell 5.

Two arms 17*a* and 17*b* are pivoted at the longitudinal slots. The corresponding ends of a pair of rods 18*a* and 18*b* are pivoted to the free ends of said arms 17*a* and 17*b*, and the rods 18*a* and 18*b* are eccentrically pivoted directly to the frame 6 at adapted second pivots 19*a* and 19*b*.

At their free ends, the rods 18*a* and 18*b* are connected to pads, designated by the reference numerals 20*a* and 20*b*, made of a suitable material and interacting at a pair of disks 21*a* and 21*b* which are laterally associated to one of said wheels 7.

Alternatively, the pads 20 can interact with an adapted lateral surface of the hub of said wheel.

It is also possible to provide an elastically deformable element, such as for example an extension spring 22, connecting the rods 18*a* and 18*b*.

The use of the present invention is as follows: a backward rotation imparted to the quarter 4 is followed by the movement of the rod member 9, which pushes the plate 14 toward the ground.

When the first pivot 13 makes contact with the upper end of the pair of slots 16*a* and 16*b*, the ends of the rods 18*a* and 18*b* which are pivoted to the arms 17*a* and 17*b* move outwards with respect to the item of footgear in contrast with the spring 22, while the pads 20*a* and 20*b* interact in a clamp-like manner with the disks 21*a* and 21*b*, achieving the braking action.

Interaction between the pads and the disks thus occurs only due to a preset rotation imparted to the quarter 4. The rotation angle is preset by the space between the upper end of the pair of slots 16*a* and 16*b* and the first pivot 13 in inactive position.

Once the user has resumed his travel position, the rod member pulls the plate 14 upwards and, by virtue of the kinematic system of the arms 17*a*, 17*b* and of the rods 18*a*, 18*b*, the pads 20*a* and 20*b* space from the disks 21*a* and 21*b*. The spring 22 ensures the spacing of the pads 20*a* and 20*b* from the disks as soon as the user has ended the braking action.

Advantageously, it is possible to provide appropriate adjustment means to vary the rotation angle of the quarter at which the braking action occurs, both to adapt it to the specific requirements of the user and to compensate any wear of the pads 20*a* and 20*b*.

Figure 4:
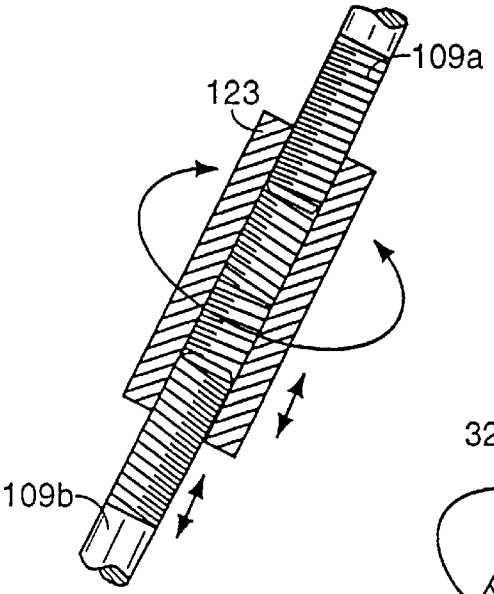
FIG. 4 is a sectional view of the means for adjusting the braking device.
Figure 5:
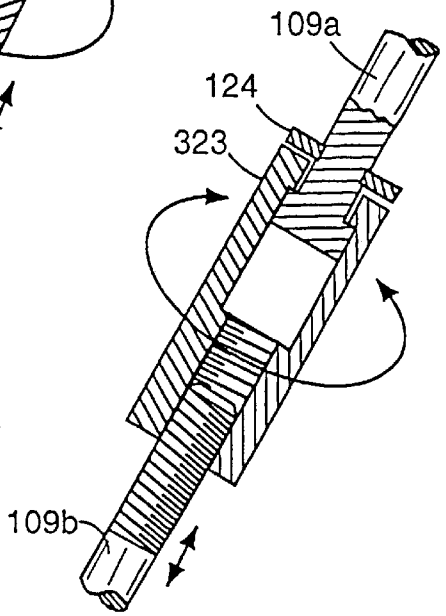
FIG. 5 is a view, similar to FIG. 4, of a further embodiment for the adjustment means.
Figure 3:
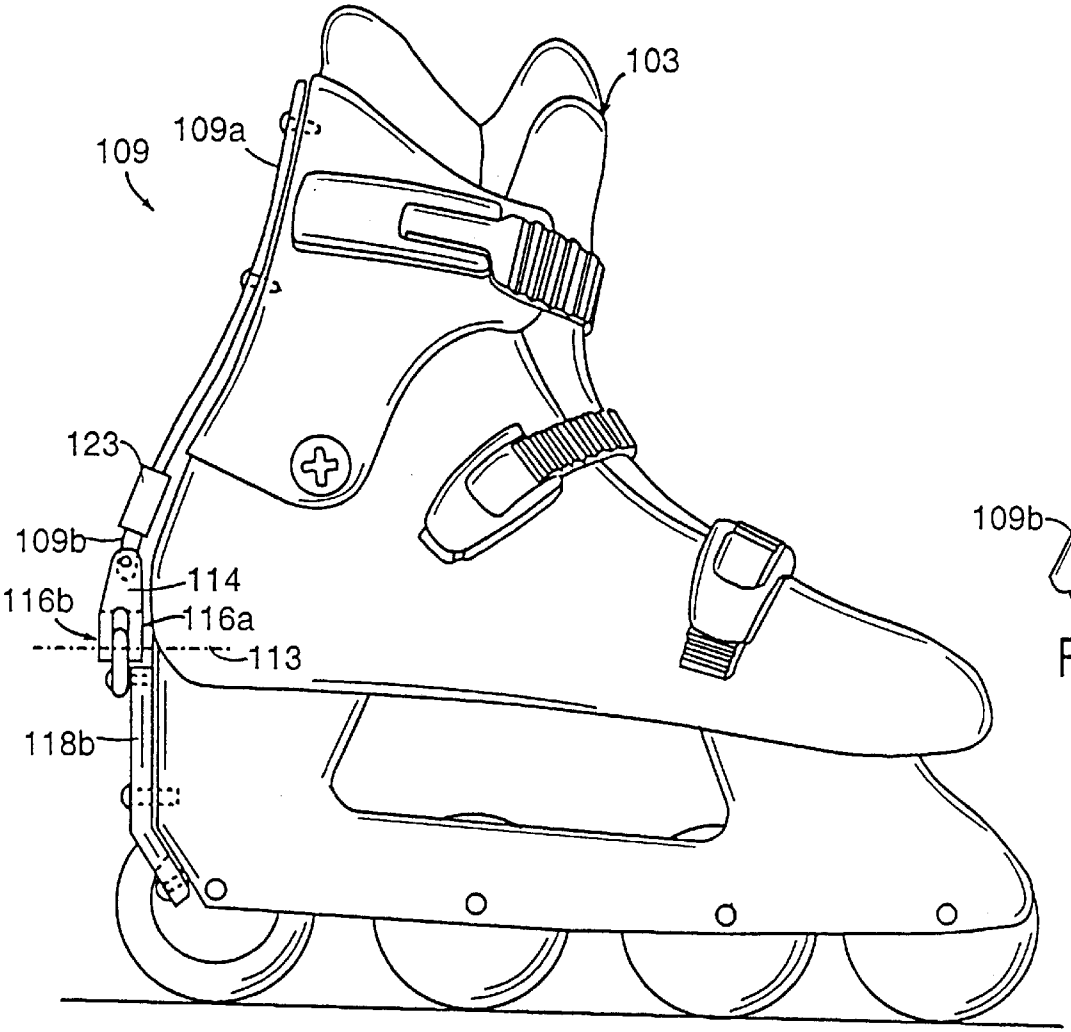
FIG. 3 is a view, similar to FIG. 1, of a second embodiment of the device provided with a means for adjusting the braking device.

In this case, illustrated in FIGS. 3–5, the rod member 109 comprises a first and a second rod members, respectively designated by the reference numerals 109*a* and 109*b*, as in FIG. 4, having opposite threads at the respective facing ends. The threads engage corresponding complementary threads formed inside a cylindrical actuation knob 123.

The rotation imparted to the knob 123 changes the overall length of the first and second rod members 109*a* and 109*b*, thus varying the distance between the first pivot 113 and the upper end of the pair of slots 116*a* and 116*b* and, ultimately, the angle at which the braking action is activated.

As an alternative, only one of the two elements may have a threaded end, the other one being simply connected to the knob 323. As shown in FIG. 5, the first rod member 109*a* has a T-shaped end arranged inside a seat defined in the knob 323 and blocked in position by a dowel 124.

Figure 7:
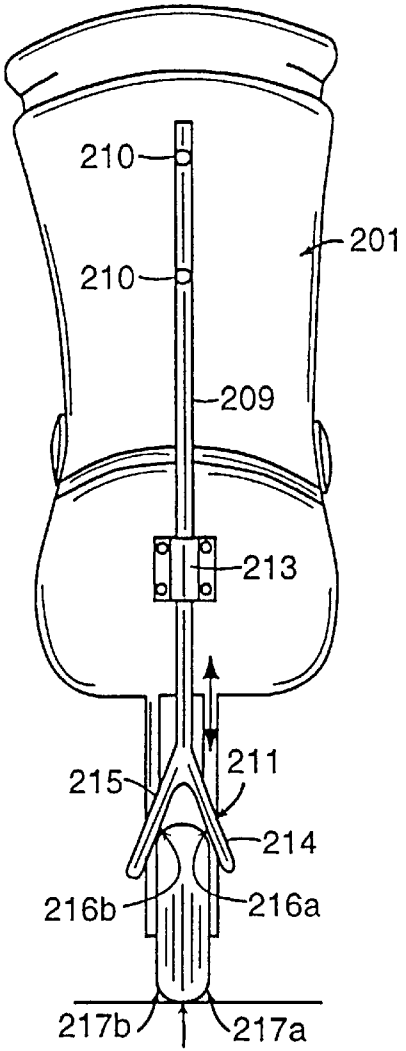
FIG. 7 is a rear view of the braking device of FIG. 6.
Figure 6:
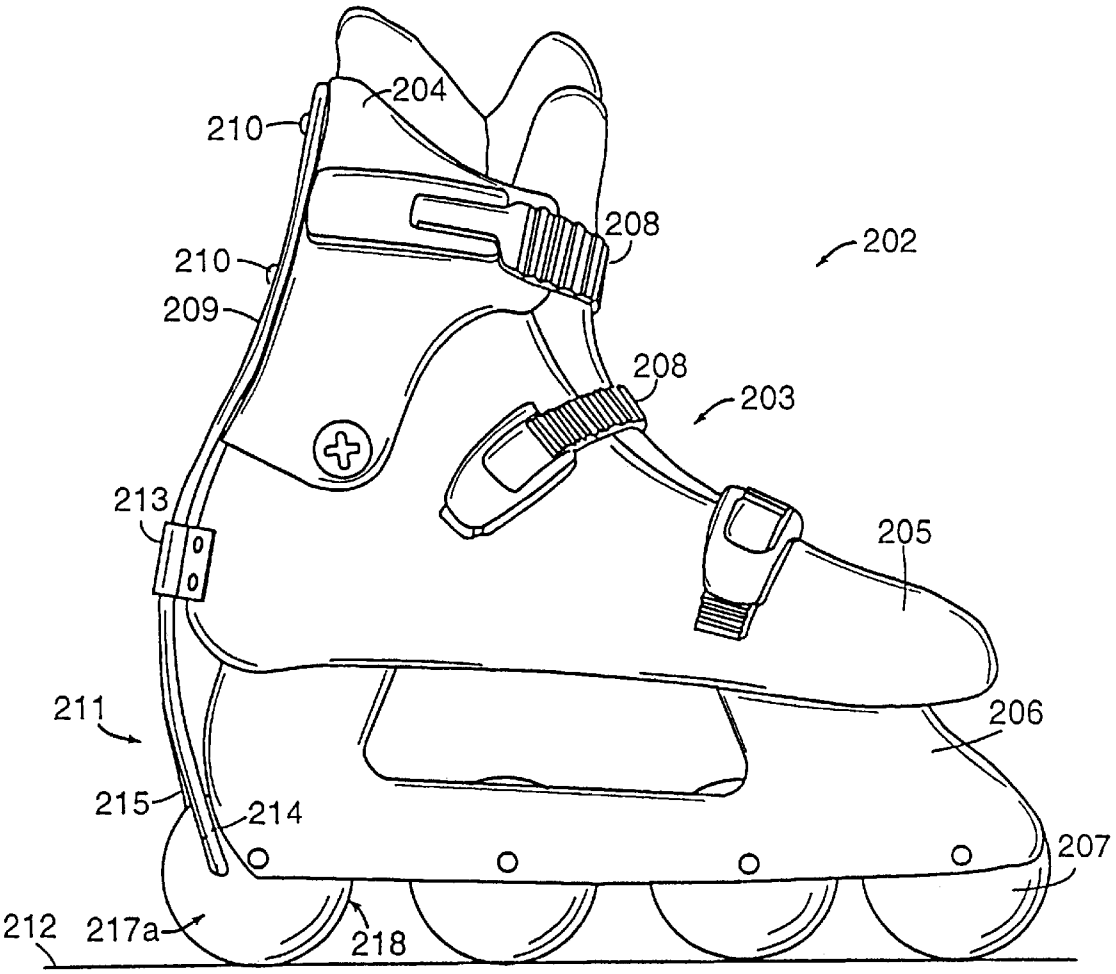
FIG. 6 is a side view of a braking device according to a further aspect of the invention.

FIGS. 6–7 illustrate a braking device 201, according to a further aspect of the invention, comprising an item of footgear 203 composed of a quarter 204, which embraces the rear lateral region of the user's leg, and is articulated to a shell 205 below which a supporting frame 206 for one or more wheels, designated by the reference numeral 207 and possibly mutually aligned, is associated.

Adapted securing levers 208 for the quarter 204 and the shell 205 are provided.

The braking device comprises at least one rod member, generally designated by the reference numeral 209, which is arranged to the rear of an item of footgear 203 and is connected to the quarter 204 by means of one or more adapted fixing means, such as for example screws or rivets 210.

The rod member 209 is shaped complementarily with respect to the quarter 204 of the shell 205 and therefore has a shape with essentially two curves suitable to arrange its terminal end 211, directed toward the ground 212, in a region adjacent to and overlying at least one wheel 207.

The rod member 209 is also freely slideable with respect to the shell 205 and is guided in this sliding by at least one adapted guide 213 which is constituted, for example, by a plate shaped as the letter omega and having ends rigidly coupled at the shell 205.

The terminal end 211 of the rod member 209 is fork-shaped and is therefore constituted by a first arm 214 and a second arm 215 whose facing surfaces 216*a* and 216*b* interact, upon a rotation imparted to the quarter 204 as described hereinafter, with the lateral surfaces 217*a* and 217*b* of the wheel 207 which are adjacent to the rolling surface 218.

The use of the braking device is in fact as follows: by virtue of the connection of the rod member 209 to the quarter 204 and of its capability to slide with respect to the shell 202, a backward rotation imparted by the user to the quarter 204 is matched by a movement of the terminal end 211 of the rod member 209 toward the underlying wheel 207.

The interaction of the facing surfaces 216*a* and 216*b* of the first arm 214 and of the second arm 215 with the lateral surfaces 217*a* and 217*b* of the wheel 207 occurs only upon a given rotation imparted to the quarter 204 which, by virtue of the configuration which can be given to the rod member 209, can be preset by the user.

This is done so as to allow the interaction of the terminal end 211 with the wheel 207 only when a given angle of backward rotation of the quarter 204 is exceeded, in order to avoid accidental braking actions.

Once this angle has been exceeded, the first and second arms thus interact with the wheel, braking the skate.

Once the user has returned to the skating position, the terminal end 211 of the rod member 209 simultaneously rises and the first and second arms thus immediately disengage from the wheel 207.

It has been observed that the invention has achieved the intended aim and objects, a braking device having been achieved which is activable by the user at a presettable angle of backward rotation of the quarter, this being obtainable by giving the required shape to the rod-like element.

Furthermore, both the activation and the deactivation of the terminal end of the rod member with respect to the wheel are very simple, the present invention thus being structurally simple and easy to industrialize.

The braking action is highly effective also by virtue of the clamp-like action of the pads on the disks.

The braking action is furthermore intrinsically obtainable in a very rapid and simple manner, and the invention is structurally simple and easy to industrialize.

The particular material usable to make the pads and the disks furthermore allows to avoid subjecting the wheels of the skate to maintenance and replacement.

The materials and the dimensions which constitute the individual components of the braking device may naturally be the most pertinent according to the specific requirements.

We claim:

1. A braking device for a wheeled assembly comprising:

a foot support for supporting a user's foot;

an upper support for supporting substantially a user's lateral ankle regions, said upper support being connected to said foot support for pivotal movement generally forwardly and rearwardly relative to said foot support about a pivoting axis which is substantially transverse to a longitudinal dimension of said foot support and extending upwardly above said pivoting axis whereby a portion of the upper support above said pivoting axis is pivotally movable between a forward position and a rearward position thereof with respect to said foot support; and a plurality of wheels rotatably supported below said foot support;

the braking device comprising:

an elongated actuator positioned substantially at a rear region of said foot support; and, a braking member connected to said actuator, said actuator having one end thereof adjacent to and being arranged operatively to engage said portion of said upper support above said pivoting axis and extending rearwardly of said pivoting axis generally downwardly from said portion to a point below said pivoting axis, said braking member being adjacent to and being arranged operatively to engage a lower portion of said actuator below said pivoting axis and being positioned substantially entirely below said actuator and said pivoting axis, an upper portion of said actuator being adapted to pivot together with said upper support above said pivoting axis and being arranged such that said lower portion of said actuator moves generally downwardly towards a downward position with respect to said foot support when said upper support pivots towards said rearward position and moves generally upwardly towards an upward position with respect to said foot support when said upper support pivots towards said forward position, and said braking member being arranged to move generally upwardly and downwardly below said pivoting axis in response to pivoting of said upper portion of said actuator forwardly and rearwardly above said pivoting axis to provide a braking action when said lower portion of said actuator is in said downward position, said braking member being disengaged from said braking action when said lower portion of said actuator is in said upward position.

2. The braking device of claim 1 wherein the length of said actuator between the said one end thereof and said braking member is adjustable.

3. The braking device of claim 1 wherein said actuator comprises a first upper rod member, a second lower rod member, and a connector for mutually interconnecting the adjacent ends of said rod members to each other intermediate the length of said actuator, said connector being adjustable for varying the length of said actuator.

4. The braking device of claim 3 wherein said connector comprises a cylindrical knob internally provided with two regions with opposite threads which interact with complimentary threaded ends of said first and second rod members.

5. The braking device of claim 1 further comprising a guide in which said actuator is slidably guided, said guide being connected to a rear region of said foot support.

6. The braking device of claim 1 wherein said actuator includes at least one elastically deformable element intermediate the length thereof between said one end thereof and a point at which said actuator is adjacent to said braking member.

7. A braking device for a wheeled assembly comprising:

a base having a surface for supporting a user's foot;

a support extending above the base and being connected to said base for pivotal movement generally forwardly and rearwardly relative to said base about a pivoting axis which is substantially transverse to a longitudinal dimension of said base and extending vertically above the pivoting axis whereby the support is pivotally movable between a forward position and a rearward position thereof with respect to said base; and a plurality of wheel elements rotatable supported below the surface of the base;

the braking device comprising:

a longitudinally-extending actuator positioned substantially at the rear region of said base, an upper end of said actuator being positioned adjacent to said support above said pivoting axis and being arranged to operatively engage said support, a lower end portion of said actuator being positioned below said pivoting axis, and said actuator extending from said upper end thereof to said lower end portion thereof rearwardly of said pivoting axis, and a braking member positioned substantially entirely below said actuator and said pivoting axis and adjacent said lower end portion of said actuator and being arranged to operatively engage said lower end portion of said actuator, said support, said actuator, and said braking member being arranged such that (a) pivotal movement of said support above said pivoting axis from said forward position thereof towards said rearward position thereof causes said lower end portion of said actuator below said pivoting axis to move downwardly and to move said braking member downwardly from one position below said pivoting axis into another position below said pivoting axis in which said braking member provides a braking action, and (b) pivotal movement of said support above said pivoting axis from said rearward position thereof towards said forward position thereof permits said braking member to be movable upwardly and away from said another position for disengagement of the braking action.

8. The braking device and skate assembly of claim 7 wherein said upper end of said actuator is connected to said support.

9. The braking device and skate assembly of claim 7 wherein said lower end of said actuator is connected to said braking member.

10. In a wheeled device comprising a base having a surface arranged to support the foot of a user, a plurality of wheels below the surface of the base and a braking element positioned rearwardly with respect to the base and arranged for movement generally upwardly and downwardly relative to the base between a first position in which said braking element provides a braking action, and a second position spaced generally above said first position in which said braking element is disengaged from said braking action, that improvement comprising:

an upper support spaced above said braking element and operatively connected to said base for pivotal movement relative thereto, said upper support extending above, and being adapted to engage the leg of a user at a position above, the ankle of the user when the foot of the user is in engagement with said surface of said base such that, in response to pivoting of the leg of the user about a pivoting axis adjacent the ankle region of the user, said upper support moves generally forwardly and rearwardly relative to said base above said pivoting axis; and, a longitudinally-extending actuator disposed rearwardly of said upper support and being arranged operatively to engage said upper support, said actuator extending generally downwardly from an upper end thereof above the ankle of the user and adjacent a portion of said upper support above the ankle of the user to a lower end thereof below the ankle of the user and adjacent said braking element, said braking element being arranged operatively to engage said lower end of said actuator and being positioned substantially entirely below said pivoting axis and said actuator such that said first and second positions of said braking element are both below said pivoting axis, said actuator being arranged such that when said upper support is pivoted rearwardly above said pivoting axis said rearward movement of said upper support above said pivoting axis causes said lower end of said actuator below said pivoting axis to move generally downwardly and move said braking element generally downwardly from said second position thereof to said first position thereof.

11. The skate of claim 10 wherein said upper support is connected to said base for pivotal movement relative to said base.

12. The skate of claim 10 wherein said upper end of said actuator is connected to a rear portion of said upper support and said lower end of said actuator is connected to said braking element.

13. In a wheeled device comprising a longitudinally extending foot support, a plurality of wheels, and a braking element positioned rearwardly with respect to said foot support and arranged for movement generally upwardly and downwardly relative to said foot support between a first position in which said braking element provides a braking action, and a second position spaced generally above said first position in which said braking element is disengaged from said braking action, that improvement comprising:

an upper support operatively connected to said foot support for pivotal movement relative thereto about an axis substantially transverse to the longitudinal dimension of said foot support, said upper support extending above, and being adapted to engage the leg of a user at a position above the ankle of the user when the foot of the user is in engagement with said foot support such that, in response to pivoting of the leg of the user about a pivoting axis adjacent the ankle region of the user, said upper support moves generally forwardly and rearwardly relative to said foot support above said pivoting axis; and, a longitudinally-extending actuator disposed rearwardly of said upper support and being arranged to operatively engage said upper support, said actuator extending generally downwardly from an upper end thereof above the ankle of the user and adjacent a portion of said upper support above the ankle region of the user to a lower end thereof below the ankle of the user and adjacent said braking element, said braking element being arranged operatively to engage said lower end of said actuator and being positioned substantially entirely below said pivoting axis and said actuator such that said first and second positions of said braking element are both below said pivoting axis, said actuator being arranged such when said upper support is moved rearwardly said rearward movement of said upper support above said pivoting axis causes said lower end of said actuator below said pivoting axis to move generally downwardly and move said braking element generally downwardly from said second position thereof to said first position thereof.

14. The device of claim 13 wherein said actuator is positioned rearwardly of said axis.

15. The device of claim 14 wherein said upper end of said actuator is connected to a rear portion of said upper support and said lower end of said actuator is connected to said braking element.

* * * * *